United States Patent [19]

Boone et al.

[11] Patent Number: 4,542,045

[45] Date of Patent: Sep. 17, 1985

[54] METHOD AND APPARATUS FOR COOLING AND COATING THE INSIDE SEAM OF A WELDED CAN BODY

[75] Inventors: Jacob J. Boone, Vermilion; George W. Stoudt, Oberlin, both of Ohio

[73] Assignee: Nordson Corporation, Amherst, Ohio

[21] Appl. No.: 537,102

[22] Filed: Sep. 29, 1983

[51] Int. Cl.[4] ..... B05D 7/22

[52] U.S. Cl. ..... 427/236; 118/313; 118/314; 118/315; 118/316; 118/317; 239/552; 427/239; 427/258; 427/265; 427/286; 427/318; 427/424

[58] Field of Search ..... 118/313–317; 427/236, 424, 239, 318, 258, 265, 286; 239/552

[56] References Cited

U.S. PATENT DOCUMENTS

| | | | |
|---|---|---|---|
| 2,895,449 | 7/1959 | Oldfield | 118/314 |
| 3,921,570 | 11/1975 | Hogstrom | 118/317 |
| 4,251,573 | 2/1981 | Holm et al. | 118/317 |
| 4,337,281 | 6/1982 | Boone | 427/236 |
| 4,353,326 | 10/1982 | Kolibas | 118/696 |
| 4,382,422 | 5/1983 | Eddy et al. | 118/313 |

*Primary Examiner*—Michael R. Lusignan
*Assistant Examiner*—Janyce A. Bell
*Attorney, Agent, or Firm*—Wood, Herron & Evans

[57] ABSTRACT

A method and apparatus for cooling and coating the inside seam of a hot welded can body. In the preferred embodiment, the apparatus includes a spray gun having a two-orifice nozzle assembly. Operation of the gun causes coating material to be sprayed concurrently from both orifices onto a seam of a can body passing by the nozzle. The first orifice emits a partially atomized spray of coating material on the seam to cool the seam and the second orifice emits an unatomized flow coat of material over the seam. The first spray acts to cool the seam making it more receptive for the coating material applied from the second orifice.

7 Claims, 7 Drawing Figures

METHOD AND APPARATUS FOR COOLING AND COATING THE INSIDE SEAM OF A WELDED CAN BODY

BACKGROUND OF THE INVENTION

This invention relates to the application of protective coatings to the interior seams of cans and more particularly to the application of protective coatings to the interior of the welded overlapped seam or the butt weld seam of a three-piece metal can.

Metal cans are generally made by either of one of two processes. One process, the two-piece can process, involves forming a drawn cup from a flat sheet of metal by a blanking process and then further forming the cup to a can configuration by an ironing process. The other process, the three-piece process, involves forming a cylindrical can body from a sheet of metal and then attaching two lids to the opposite ends of the body. The present invention is concerned only with the application of protective coatings to three-piece cans.

In the manufacture of three-piece cans, the cylindrical can bodies are formed by wrapping a sheet of metal around a so-called stubhorn. The ends of the sheet are either butted or overlapped and secured together by a welded seam, a soldered seam or a cemented seam. The interior of the seam is then coated with a protective coating, the function of which is to protect the contents of the can against the metal contaminants. In the application of this coating, continuity is extremely critical because any pinholes, cracks or imperfections in the integrity of the coating will generally render the can unsuitable for most applications.

After application, the coating is cured by heating. This curing process is applied only to the area of the can seam. Therefore, any coating material applied to the interior of the can which is not upon the seam area will not be cured. Uncured coating material will also contaminate the contents of a can.

The present invention is primarily concerned with applying this continuous coating onto welded can seams. Welded can seams tend to have more irregular projections than soldered can seams and usually require a coating thickness of about six milligrams of dried resin per square inch. A method of coating welded can seams is disclosed in Boone U.S. Pat. No. 4,337,281. The disclosure of this patent is incorporated herein by reference. The Boone '281 patent discloses coating a welded can seam by applying a flow coat of higher solids coating material onto the welded can seam. A flow coat generally refers to a non-atomized liquid curtain of coating material. A higher solids coating is generally 20 to 40 percent solids or more. This is by far the best method of applying a stripe of coating material onto the welded seam of a can. However, since the coating is applied immediately after the welding operation and the welding operation increases the temperature of the seam to about 1300° F., the coating material does not always cover the can seam as desired. The heat of the seam either causes the coating to boil, leaving a pitted surface, or causes the coating to run off the seam before the coating is cured at the heating station.

Attempts have been made to cool the cans prior to the coating step, but due to the high speed of the operation, they have been unsuccessful. For example, one attempt has been to spray the seam area with a jet of air to cool the seam area. Another method is to spray the outside of the seam area with water. The can bodies simply move too fast to be cooled by the air jet and coating with water has been very unsuccessful. The water per se is a contaminant to the coating. If any water is on the seam area, the coating material will cover it. When the coated can advances to the curing station, the elevated temperature causes the water to boil, pitting the surface of the coating.

Accordingly, it is an object of the present invention to provide a method and apparatus for cooling the seam of a can to facilitate the application of a stripe of coating material. Furthermore, it is an object of the present invention to accomplish this without substantially increasing the cost of the coating equipment.

It is further an object of the present invention to apply a continuous stripe of coating material onto a welded seam of a can wherein the stripe is uniform in thickness, continuous and not excessively thick.

These objectives are accomplished by spraying a cooling material onto the seam of the can, and subsequently applying a flow coat of material onto the seam of the can. The cooling material or coolant is a material which is compatible (i.e., mixes or dissolves) with the coating material. Preferably, the coolant is the same material as the coating material, the solvent used in the coating material or the coating material with a lower solids content.

In the preferred embodiment, these objectives are accomplished by spraying a coating material onto the seam of a can from a nozzle having two orifices. The first orifice emits an atomized cooling spray of coating material, and the second orifice emits an unatomized or flow coat of material.

DETAILED DESCRIPTION OF THE INVENTION

Figure 1:
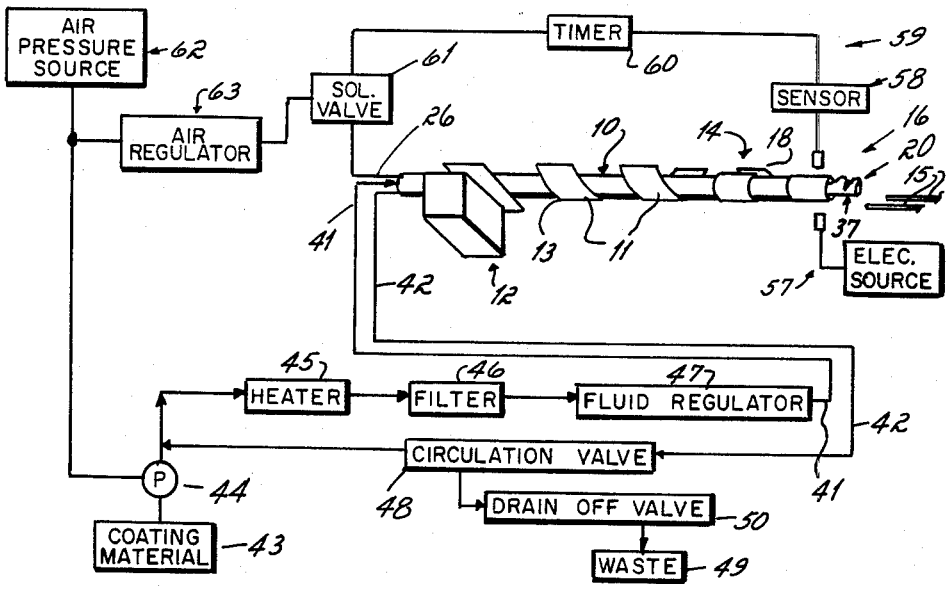
FIG. 1 is a diagrammatic illustration of a can body production line for practicing the novel inside striping method of the present invention including the novel apparatus of this invention.

Referring first to FIG. 1, there is illustrated diagrammatically a standard can production line used in the production of cylindrical can bodies. This can line includes a stubhorn 10 which acts as a mandrel around which can bodies 11 are formed as they pass downstream over the stubhorn. The can bodies 11 are moved longitudinally over the stubhorn from a magazine 12 by lugs of a chain conveyor (not shown) which engage the rear edge 13 of the can bodies and push the can bodies along the stubhorn.

In the final stages of the movement of the can bodies over the stubhorn 10, the ends of the sheet metal are overlapped and joined. The bodies are seamed together by a weld at a welding station indicated by the numeral 14. As the bodies pass off the stubhorn 10 and onto the rails 15, they are pushed through an inside striping station indicated by the numeral 16. At this station, a stripe of protective material is sprayed over the overlapped seam 18 of a can. From the striping station, the can bodies advance along a series of rails 15 for further processing such as curing.

The striping station 16 includes an airless spray apparatus 20 secured to the end of the stubhorn. This apparatus is so positioned that the can bodies pass over it before passing into the rails 15. The spray apparatus is secured to the stubhorn by a rod 21 which extends from the downstream end of the stubhorn into an aperture in the spray apparatus 20. The spray apparatus includes a spray activator or module 22 housed within a mounting block 23. The mounting block is preferably cylindrical and includes a stepped axial bore 24 adapted to receive the module 22.

The mounting block further includes an air flow passage 25 which communicates with an air pressure line 26 and extends to the axial bore 24 at port 27. A liquid spray material inlet passage 30 and a liquid outlet fluid passage 31 extend through block 23 to the stepped axial bore 24 at ports 32 and 33, respectively.

The gun module 22 has a threaded nose piece 35 which when the module is mounted in the stepped axial bore 24 extends completely through the stepped axial bore and threads into an internally threaded section 36 of a nozzle 37. When the nose piece is fully threaded into section 36 of nozzle 37, the module 22 contacts a shoulder 38 formed in the bore 24. When so located, the liquid inlet port 32 of block 23 is aligned and in communication with the annular groove 39 of the module 22 and air pressure inlet port 27 is aligned with annular groove 40 of module 22.

Figure 5:
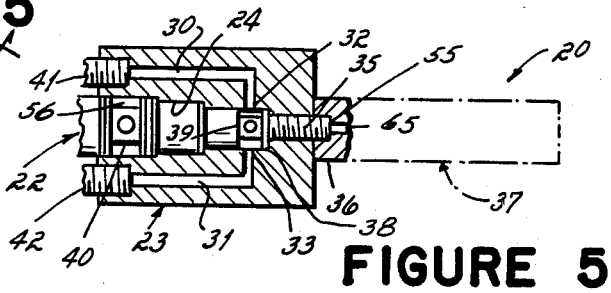
FIG. 5 is a cross-sectional view partially broken away taken on line 5—5 of FIG. 3.

As shown in FIGS. 1 and 5, the spray apparatus 20 is the so-called circulating flow type. That is, there is a continuous flow of fluid or coating material to the apparatus through a liquid inlet 41 which communicates with inlet passage 30. There is also a continuous flow of coating material from the fluid outlet passage 31 to return line 42. As a result of this continuous flow, the temperature of the coating material may be maintained constant in the spray apparatus even when the apparatus is not in use and the fluid would otherwise be stationary. Since some coating materials are applied at a temperature substantially above room temperature, it is important that they not be permitted to stand and become hardened in the spray apparatus. The circulating flow of fluid through the spray apparatus 20 precludes this hardening or the setting of the lacquer.

As shown diagrammatically in FIG. 1, the fluid inlet line 41 originates at a source 43 of coating material and is caused by a pump 44 to pass through the heater 45, a filter 46 and a regulator 47 to the spray apparatus via lines within stubhorn 10. The return line 42 directs coating material to a circulation valve 48 which either directs the fluid back to line 41 or to a waste receptacle 49 by way of a drain off valve 50.

The gun module 22 is a pneumatically opened, spring closed check valve which when open permits liquid to flow from the inlet port 32 through an outlet orifice 55 to nozzle 37. When the valve is closed, liquid flows into the modules through inlet port 32 and out through recirculating outlet port 33. The pressurized air which opens the check valve of the module 22 enters into the pressure chamber 56 of a module via port 27. A flow control module suitable for a use in this application is described in detail in U.S. Pat. No. 3,840,158 issued Oct. 8, 1974 which is hereby incorporated into this application by reference.

The emission of liquid spray from the spray apparatus 20 is turned on and off in synchronization with movement of the can bodies 11 over the stubhorn 10. Activation of a gun is initiated by a can body interrupting a light beam of a photocell sender 57 and receiving/sensor unit 58. Upon each interruption of the light beam, an electrical pulse is sent through a solenoid control circuit 59. This solenoid control circuit 59 activates timer 60. The timer sends a signal to a solenoid valve 61 causing a valve spool of the solenoid valve 61 to shift so as to connect the air line 26 to a source of air pressure 62 via a regulator 63, thereby actuating the gun module 22 and causing coating material to be emitted from the nozzle onto the seam 18 of the passing can body.

A predetermined time after the interruption of the light beam, that can which had broken the light beam passes out of alignment with nozzle 37. After that predetermined time, the timer circuit 59 interrupts the signal to solenoid 61, causing it to be de-energized and the control circuit to be reset. Upon de-energization of the solenoid of solenoid valve 61, the spool of valve 61 moves back to the position in which the air line 26 is connected to atmospheric pressure. This results in the valve in module 22 closing which immediately cuts off the flow of spray from the nozzle 37 until the timer 60 re-energizes the solenoid of solenoid valve 61. This sequence is repeated each time a can body passes the sensor 58.

Figure 2:
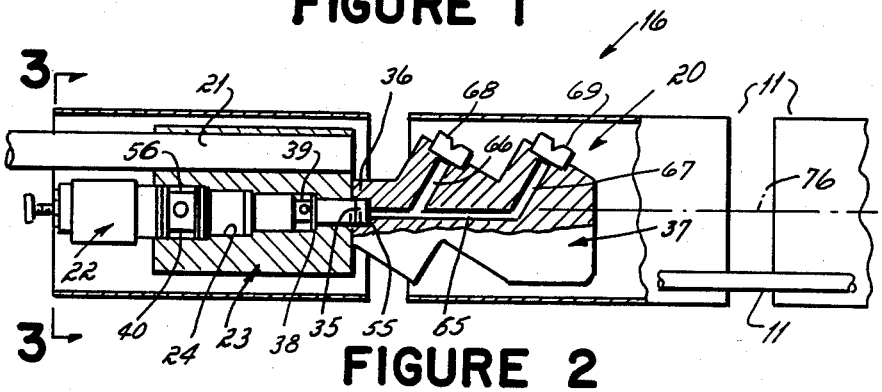
FIG. 2 is a cross-sectional view of the inside striping mechanism of the present invention wherein the nozzle is partially broken away.
Figure 3:
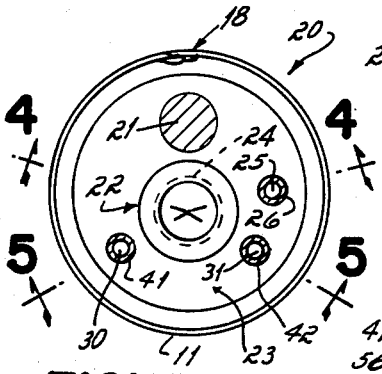
FIG. 3 is an end elevational view of the coating apparatus of the present invention taken at line 3—3 of FIG. 2.
Figure 4:
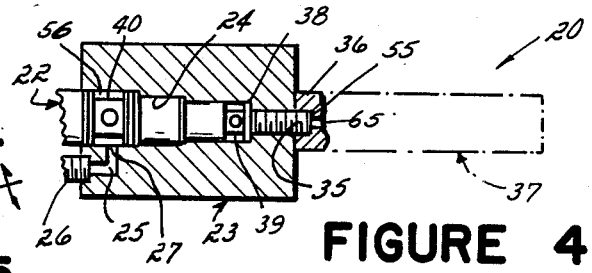
FIG. 4 is a cross-sectional view partially broken away taken at line 4—4 of FIG. 3.

As shown in FIG. 2, the nozzle 37 for use in the present invention includes a central axial passage 65 extending from the outlet orifice 55 of the module 22 into the nozzle. This central axial passage communicates with first and second upwardly extending passages 66 and 67, respectively which extend to the first and second nozzle orifices located in nozzle tips 68 and 69, respectively.

The orifices in both nozzle tips concurrently direct sprays of coating material onto the seams 18 of passing can bodies. Preferably, the nozzle tips are both cross cut nozzle tips of the type described in Rood U.S. Pat. No. 4,346,849.

The purpose of the first spray, i.e., the spray emitted through first nozzle tip 68 is merely to cool the can seam to a temperature at which the seam readily accepts the stripe of coating material sprayed from the second nozzle tip 69. The material emitted from the first nozzle tip 68 should be at least partially atomized or just about to atomize at the time it strikes the can seam. The material emitted from the second spray nozzle orifice should strike the can seam as a liquid curtain or flow coat of material.

It is theorized that the cooling effect of the spray emitted from the first nozzle tip 68 cools the can seam by the evaporation of the solvent in the coating material. In other words, the heat removed is due in large part to the heat of evaporation of the solvent. The solvent will evaporate more quickly when the spray of coating material is in a totally atomized state. However, in a totally atomized state, the material is spread out over a larger area. Therefore, it is believed that the most efficient cooling occurs when the coating material striking the can seam is partially atomized or just about ready to atomize, i.e., where the material is in a rippled state or ligamented state.

With respect to the coating applied from the second nozzle tip 69, this spray of coating material must be applied to the can seam as a curtain of material, a flow coat. The method of obtaining a flow coat of material is described more particularly in Boone U.S. Pat. No. 4,337,281.

Figure 6:
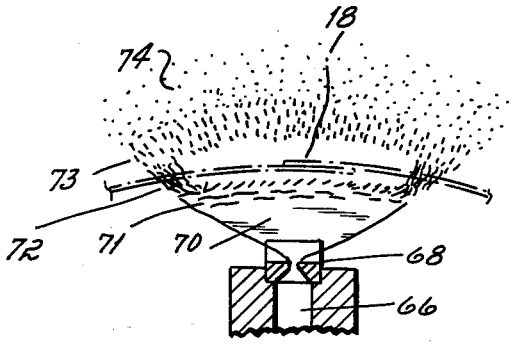
FIG. 6 is a cross section of the spray emitted from the first orifice of the nozzle.
Figure 7:
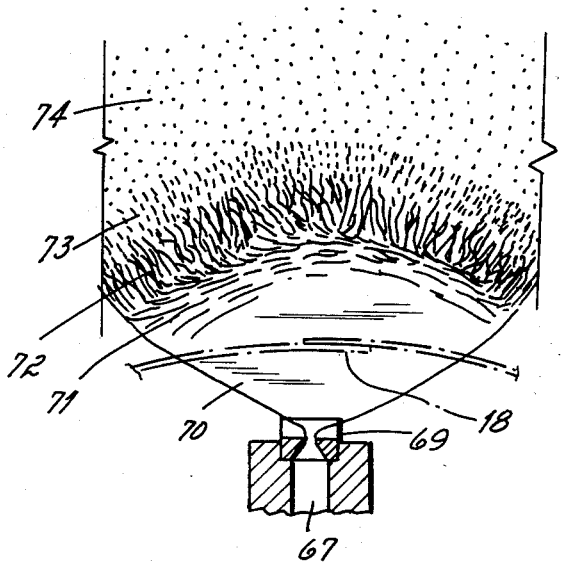
FIG. 7 is a cross section of the spray emitted from the second orifice of the nozzle.

These methods of spraying are further described with respect to FIGS. 6 and 7. FIG. 6 depicts a can seam 18 passing by nozzle tip 68, and FIG. 7 depicts that can seam 18 passing by nozzle tip 69. As shown in these figures, the can seam 18 is equidistant from both nozzle tips. The nozzle tips 68 and 69 have different orifices to create two different spray patterns. The orifice in the first nozzle tip 68 is smaller than the orifice in the second nozzle tip 69. Therefore, the spray emitted from the first nozzle tip 68 is less than the spray emitted from the second nozzle tip 69 in terms of liquid volume. Furthermore, the spray from the first nozzle tip will atomize more readily than the spray from the second nozzle tip. Both spray patterns emitted from nozzle tip 68 and nozzle tip 69 start out as a solid curtain of material 70. The spray pattern spread out as they continue away from the nozzle tips. As the sprays spread out, they also thin out until eventually external forces, particularly air disturbances, cause ripples 71 in the spray pattern. The ripples then break up into longitudinal ligaments indicated by numeral 72. These ligaments subsequently break up as they move away from the nozzle into droplet 73 which then atomize into a fine spray 74.

With respect to both sprays, the break up and atomization occurs at various distances from the nozzle depending in part on the operational conditions of the spraying apparatus. Under high pressures, the atomization occurs closer to the orifice due to the increased violent forces caused by the higher pressures themselves. In addition, the fan angle widens more quickly under higher pressures which also causes materials to atomize more quickly. Other factors which affect the distance the material will travel before it atomizes includes solids content of the coating material, its viscosity and its temperature. Another factor which may affect operation of the present invention is the distance from the nozzle tips to the can seam. As shown in the drawing, both tips 68 and 69 are equidistant from the seam of the can. Alternately, tip 68 could be positioned farther away from the can seam to further effect atomization.

For use in the present invention, the spray emitted from the first nozzle tip when it strikes the can seam should be at least about partially atomized. The spray of material emitted from the second nozzle tip 69 must be in a solid curtain of material when it strikes the can body. Described in different terms, an arbitrary axis such as an axis 76 extending through the center of the moving can bodies is established. The spray emitted from the first nozzle tip must be at least a partially atomized spray at a point which is a predetermined distance (d) above or from this axis 76. That predetermined distance, of course, would be distance from the axis to the passing can seams. The spray material emitted from the second nozzle must be an unatomized curtain of material at that predetermined distance (d) from that axis 76. Thus, even though the distances from the two nozzle tips to the can seams may not be the same, the effect will be the same, i.e., an atomized spray sprayed onto the passing can seams from the of the first nozzle tip 68, and a second unatomized spray sprayed from the orifice of the second nozzle tip 69.

In practicing the present invention, the relationship of the two nozzle tips is important. The first nozzle tip must spray an amount effective to cool the seam, making it suitable for coating with the second spray. Of course, the material sprayed from the first nozzle will remain in the area of the seam and will build up in the seam area. It is undesirable to have an excessive amount of coating material along the seam. It is costly, and the cure may not be totally effective. Therefore, if the combined amount of spray material sprayed from both tips combined is excessive, the coating will be unsatisfactory. Generally, the finished coating stripe should be in the range of 7–10 mg. of cured film per linear inch where the stripe is $\frac{1}{2}''$ wide, i.e., 14–20 mg of cured film per square inch.

In order to better enable one of ordinary skill in the art to practice the invention, the following two examples are presented. In there examples, welded seam cans are produced by a Soudronic body maker and the seams were coated by a Nordson airless flow coat apparatus as described in the preceeding specification. In both examples, solids content of the coating material was about 30%, the fluid pressure was 250 psi at the regulator and both nozzle tips were about $\frac{1}{8}''$ from the passing can seams. The only variation in these two examples was the nozzle tips. All nozzle tips are cross cut nozzle tips of the type described in U.S. Pat. No. 4,346,849. These nozzle tips are characterized by the flow rate through their orifices of a material having a viscosity of 30 seconds using a Zahn No. 2 cup at room temperature where the material is sprayed at a pressure of 100 psi. Also, the nozzles are described with respsect to the width of the fan pattern at one inch distance from the orifice.

EXAMPLE 1

Using the forming and coating apparatus described above, welded can seams were coated. The first nozzle tip 68 of the coating apparatus had a flow rate of 0.015 gallons per minute and a fan pattern of $1\frac{1}{8}''$ width at one inch, and the second nozzle tip 69 had a flow rate of 0.02 gallons per minute and a 2 9/16″ spray width at one inch. The film as applied to the can seam was heavier than required. However, the protection appeared to be adequate, and the cure was totally effected.

EXAMPLE 2

The same procedure was used as in Example 1 except that the first nozzle tip 68 had a flow rate of 0.0075 gallons per minute and a fan pattern of 1 5/16″ at one inch, and the second nozzle tip 69 had a flow rate of 0.015 gallons per minute and a fan pattern of 2 7/16″ at one inch. The applied film on the can seam was approximately four and three-quarters milligram per inch with an ammeter reading of 70, 75, 80, 85 and 65 milliamps as measured on an ammeter (Enamel Rater Model 10780), manufactured by the Wilkens-Anderson Company of Chicago, Ill. These readings are commonly referred to as Waco readings. Examination of the seam under a microscope after soaking two minutes in copper sulfate showed only minimal rusting less than six dots of exposure along the seam of the can. This result is excellent.

It will be obvious to one of ordinary skill in the art to employ different methods to practice the present invention. Potential means to vary the procedure disclosed in the detailed description of the invention would include using two different spray guns, a first spray gun to spray the first cooling spray of material onto the can seam the second gun to spray the flow coat of material onto the seam. Furthermore, the first spray of material does not necessarily have to be the coating composition. For example, if two separate spray guns were used, the first spray gun could spray merely a solvent which was compatible with the coating material or it could spray a coating material having the same polymeric material but having a lower solids content than the coating material. This would effectively cool the seam more efficiently. Both the solvent and the lower solids coating material would be compatible with the coating composition since they would both mix with the coating composition. Of course, the apparatus would be more complicated and expensive. These methods are also currently impractical due to the small area the coating apparatus is allowed in a can production line.

Accordingly, from the preceeding description, one of ordinary skill in the art is enabled to practice the specific embodiment of the invention as well as obvious variants of this specific embodiment.

With respect to this, applicants are not bound by the specific embodiment of the foregoing disclosure, but only by the claims in which we claim:

1. A method of applying a continuous impervious protective coating in the form of a stripe over a hot longitudinal seam area of can bodies to prevent running and pitting of said coating which method comprises the steps of:

passing said can bodies over a first and a second spray means;

applying a cooling spray of a first material from said first spray means onto said seam area;

spraying from said second spray means an unatomized spray of a coating material onto said seam area in an amount effective to form a stripe of coating material over the seam area; and wherein said first material is compatible with said coating material.

2. A method claimed in claim 1 wherein said first material is the same as said coating material.

3. The method claimed in claim 1 where said first spray means applies a partially atomized spray of said first material.

4. The method claimed in claim 2 wherein said first and second spray means comprise one spray gun attached to a nozzle having two orifices, said spray of said first material being emitted from a first orifice and said unatomized spray being emitted from a second orifice.

5. A method of applying a continuous impervious protective coating in the form of a stripe over the longitudinal welded seams of can bodies which method comprises the steps of:

moving a series of can bodies having longitudinal welded seams along a can forming line past an airless spray applicator;

said applicator having a first and a second orifice;

locating said airless spray applicator interiorly of said cans with said orifices located in close proximity to said moving can seams;

supplying a liquid coating material from a source of said coating material to said airless spray applicator at a pressure sufficient to atomize said liquid material when sprayed from said first and said second orifices;

spraying said liquid coating material as an airless spray fan of coating material from said orifices onto the welded seam of said can bodies;

said seam areas of said can bodies being located sufficiently close to said second nozzle orifice that said liquid material is applied to said seam area as an unatomized solid curtain of liquid coating material; and said seam areas of said can bodies being located sufficiently far from said first orifice that the liquid material is applied to said seam areas as at least a partially atomized spray of liquid coating material.

6. An apparatus for applying a continuous impervious protective coating in the form of a stripe over the longitudinal weld seam areas of a series of can bodies having longitudinal welded seams and moving along a can forming line, said apparatus adapted to fit within the interior of said can bodies moving along said can forming line;

comprising means to spray a coating material from a first and a second orifice, said orifices directing said coating material at the seam areas of can bodies moving past said orifices; and wherein said first orifice is operable to direct at least a partially atomized spray of coating material upon the seam areas of can bodies moving past said first orifice, and said second orifice is operable to direct an unatomized solid curtain of coating material upon the seam areas of can bodies moving past said second orifices.

7. An apparatus for applying a continuous impervious protective coating in the form of a stripe over the longitudinal welded seam areas of a series of can bodies each having a longitudinal welded seam and moving over the stubhorn of a can forming line:

said apparatus being mounted upon said stubhorn and adapted to fit within the interior of can bodies moving over said stubhorn, said apparatus including means to spray a coating material onto the seam areas of can bodies moving over said stubhorn, said spray means including a first orifice and a second orifice, said first orifice being operable to spray a partially atomized spray of coating material upon the same areas of passing can bodies and said second orifice being operable to direct an unatomized solid curtain of said coating material upon the seam areas of passing can bodies.

* * * * *

UNITED STATES PATENT AND TRADEMARK OFFICE

CERTIFICATE OF CORRECTION

PATENT NO. : 4,542,045

DATED : September 17, 1985

INVENTOR(S) : Jacob J. Boone & George W. Stoudt

It is certified that error appears in the above-identified patent and that said Letters Patent is hereby corrected as shown below:

In column 8, Line 53, "same" should be --seam--.

In column 6, line 20, "there" should be --these--.

Signed and Sealed this

*Twenty-ninth* Day of *April 1986*

[SEAL]

*Attest:*

DONALD J. QUIGG

*Attesting Officer*

*Commissioner of Patents and Trademarks*